US011221120B2

(12) United States Patent
Hermitte et al.

(10) Patent No.: US 11,221,120 B2
(45) Date of Patent: Jan. 11, 2022

(54) LIGHT MODULE AND LIGHTING DEVICE FOR A MOTOR VEHICLE COMPRISING SUCH A LIGHT MODULE

(71) Applicant: VALEO VISION, Bobigny (FR)

(72) Inventors: Michel Hermitte, Angers (FR); Sebastien Bera, Angers (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 16/983,399

(22) Filed: Aug. 3, 2020

(65) Prior Publication Data

US 2020/0363033 A1 Nov. 19, 2020

Related U.S. Application Data

(63) Continuation of application No. 16/293,279, filed on Mar. 5, 2019, now Pat. No. 10,738,957, which is a continuation of application No. 15/716,106, filed on Sep. 26, 2017, now Pat. No. 10,267,475.

(30) Foreign Application Priority Data

Sep. 26, 2016 (FR) ..... 16 59051

(51) Int. Cl.

| | |
|---|---|
| ***F21S 41/29*** | (2018.01) |
| ***F21V 17/00*** | (2006.01) |
| ***F21V 17/06*** | (2006.01) |
| ***F21V 17/16*** | (2006.01) |
| ***F21S 41/143*** | (2018.01) |
| ***F21S 41/19*** | (2018.01) |
| ***F21S 41/26*** | (2018.01) |
| ***F21S 41/151*** | (2018.01) |
| ***F21S 45/47*** | (2018.01) |
| *F21Y 115/10* | (2016.01) |
| *F21Y 103/10* | (2016.01) |
| *F21W 102/13* | (2018.01) |
| *F21W 102/00* | (2018.01) |

(52) U.S. Cl.

CPC ..... *F21S 41/295* (2018.01); *F21S 41/143* (2018.01); *F21S 41/151* (2018.01); *F21S 41/19* (2018.01); *F21S 41/192* (2018.01); *F21S 41/26* (2018.01); *F21S 41/29* (2018.01); *F21S 45/47* (2018.01); *F21V 17/005* (2013.01); *F21V 17/06* (2013.01); *F21V 17/164* (2013.01); *F21W 2102/00* (2018.01); *F21W 2102/13* (2018.01); *F21Y 2103/10* (2016.08); *F21Y 2115/10* (2016.08)

(58) Field of Classification Search

CPC ..... F21S 41/295; F21S 41/275; F21S 41/29; F21S 41/143; F21S 45/47; F21V 17/164; F21V 17/06; F21V 17/005; F21W 2102/00; F21Y 2115/10

See application file for complete search history.

(56) References Cited

U.S. PATENT DOCUMENTS

| | | | |
|---|---|---|---|
| 2011/0051414 | A1 | 3/2011 | Bailey et al. |
| 2012/0206911 | A1 | 8/2012 | Pickard |
| 2014/0160738 | A1 | 6/2014 | Rozot |
| 2014/0268748 | A1 | 9/2014 | Lay |

*Primary Examiner* — Kevin Quarterman

(74) *Attorney, Agent, or Firm* — Oblon, McClelland, Maier & Neustadt, L.L.P.

(57) ABSTRACT

A light module includes at least one light source, a light source support, and an optical element suitable for receiving rays emitted by the light source. The optical element includes structure for positioning the optical element in a predefined position on the support and an elastic attachment device for attaching the optical element in the predefined position on the support.

20 Claims, 3 Drawing Sheets

LIGHT MODULE AND LIGHTING DEVICE FOR A MOTOR VEHICLE COMPRISING SUCH A LIGHT MODULE

CROSS-REFERENCE TO RELATED APPLICATIONS

This application is a continuation of U.S. application Ser. No. 16/293,279, filed Mar. 5, 2019, which is a continuation of U.S. application Ser. No. 15/716,106, filed Sep. 26, 2017 (now U.S. Pat. No. 10,267,475), which is based upon and claims the benefit of priority from French Application No. 16 59051 filed on Sep. 26, 2016; the entire contents of which are incorporated herein by reference.

BACKGROUND

The present invention concerns the field of light modules for motor vehicles, and in particular lighting and/or signaling modules.

A motor vehicle is equipped with headlamps, or headlights, intended to illuminate the road in front of the vehicle, especially at night or during bad weather. These headlamps can generally be used according to two lighting modes: a first "high beam" mode and a second "low beam" mode. The "high beam" mode brightly illuminates the road far in front of the vehicle, potentially dazzling road users travelling in the opposite direction. The "low beam" mode provides more limited illumination of the road, but nevertheless offers good visibility without dazzling other road users. These two lighting modes are complementary.

In each of these operating modes, in order to avoid dazzling road users travelling in the opposite direction, it is necessary to control the positioning and orientation of each of the headlamps, and more particularly of each of the elements constituting said headlamps.

The headlamps can comprise one or more light modules comprising a light source, an optical deflection element, and an optical projection element, each of these elements being mounted on a support. Each element of the module is attached to the support by at least one attachment element, the support itself being attached to the vehicle.

The elements that typically constitute these light modules are generally bulky and complicated to assemble and configure in such a way as to obtain light rays that comply with photometric standards.

BRIEF SUMMARY

In this context, the aim of the present invention is to propose a light module that is simpler to assemble and adjust.

A light module according to the invention comprises at least one light source, a light source support and an optical element suitable for receiving rays emitted by the light source, the optical element comprising means for positioning said optical element in a predefined position on the support and elastic attachment means for attaching said optical element in the predefined position on the support.

The "predefined position" should be understood to mean the desired theoretical position of the optical element relative to the position of the light source or sources.

The positioning means help ensure the optical element is correctly positioned before it is attached to the light source support. Also, according to the invention, a light module is made easier to assemble by incorporating positioning means and elastic attachment means into the optical element, thus reducing the number of assembly steps or the risk of play.

The light source support is arranged so as to receive at least one printed circuit board and/or one electronic component, or indeed so as to directly form said printed circuit board on which the light sources and the electronic components are mounted. As a non-limiting example, the support can consist of a planar wall against which a printed circuit board is pressed, the light source being attached to said board.

The optical element is arranged against the support. It can, in particular, be pressed against the support, i.e. one of the surfaces of the optical dement, in particular the face from which the elastic attachment means protrude, is in contact with one of the faces of the support.

The optical element can further comprise at least one arrangement intended to receive an electronic component arranged on the support. This arrangement can, for example, comprise a window provided in the volume of the optical element, or indeed a specific domed shape of the optical element forming a clearance relative to the support.

The optical element can comprise at least one arrangement in the form of a recess intended to allow air to flow to the support, in order to cool one or more components of the light module, in particular electronic components and, for example, the light sources. The arrangement provided can, in particular, consist of one or more windows passing through the optical element.

The positioning means of the optical element can comprise male or female elements, respectively, configured to engage with female or male elements, respectively, carried by the light source support. As a non-limiting example, the positioning means carried by the optical element can be in the form of one or more pins that match one or more bores provided in the support. In particular, the bore can be in the form of an oblong hole. In one specific embodiment, one of the semi-circles at the end of the oblong hole is wider than the semi-circle at the other end of the oblong hole. The pin cooperating with this oblong hole can thus be designed with a corresponding shape, the two shapes when combined acting as a poka-yoke. In another alternative, the dimensions of the pin of the means for positioning the optical element are such that it is able to enter the bore on the side with the wider semi-circle and then fitted and held on the side with the narrower semi-circle.

According to one feature of the invention, the means for positioning the optical element can comprise at least one post of the elastic attachment means and complementary positioning means can comprise at least one bearing surface formed by one edge of the support, the post bearing on the bearing surface in order to bring the optical element to the predefined position.

The elastic attachment means comprise at least one elastic blade, carried in particular by a segment or a frame that extends protruding from the optical element, configured to engage with the rim of a panel, the elastic blades being deformed when the optical element passes along said rim before returning to their original position and snap fitting into place behind said rim when the optical element is in the predefined position.

"Snap fitting" should be understood to mean that when the optical element is being fitted on the support, the elastic blades are elastically deformed upon contact with the panel before returning to their original shape behind said panel, the rim of the panel then forming an abutment preventing the release of the elastic blades. For this purpose, the blades have a shape that is suitable for being elastically deformed when they pass in one direction and of being blocked in the other direction, and, for example, an inclined plane and an abutment at the free end of said inclined plane. Once the optical element is in position, the elastic blades are no longer compressed by the edges of the support and return to their initial shape, which brings them into contact with the face of the panel turned away from the optical element.

The elastic attachment means and the support are configured to engage with each other only when the optical element is in a predefined position on the support. More particularly, the elastic attachment means comprise a frame and the elastic blade carried by said frame, and each frame comprises a post configured to come into contact with an arrangement formed on the support. This arrangement can be in any form that allows it to cooperate with the post, and can, in particular, be in the form of a shoulder on which the post of the frame rests.

It can be seen from the above that the elastic attachment means both help in the positioning operation, owing to the shape of the frame and the posts that form it, and the way in which they cooperate with complementary shapes provided on the support, and subsequently play their role in holding the optical element in said predefined position.

The optical element is made from a transparent or translucent material. As a non-limiting example, the transparent or translucent material can comprise polycarbonate (PC), poly(methyl methacrylate) (PMMA), silicone or any related material. Certain parts of the optical element can be made from a different material to that used for the rest of the parts of said optical element. For example, the elastic attachment means essentially consist of polycarbonate and/or poly(methyl methacrylate), whereas the rest of the optical element consists of silicone. This ensures that the part of the optical element directly facing the light sources or the electronic components arranged on the support is made from silicone, a material more resistant to the heat produced by these components.

The optical element can be produced by any industrial method used for producing similar parts. Alternatively, the optical element is produced by molding or by injection. Each element or sub-part of the optical element can be produced according to a different method to that used to produce the other elements or sub-parts of the optical element.

The optical element can comprise one or more optical elements, forming, for example, at least one microlens acting as a primary optical element in the direct vicinity of the light source or light sources, in particular in applications in motor vehicle lighting devices in which the light modules are mounted on a plate on which a projection lens is also positioned, thus forming a secondary optical element. In the light module according to the invention, the optical element can comprise a plurality of microlenses, each microlens being intended to cooperate with a different light source, being positioned facing said light source when the support element is in the predefined position relative to the support. Each pair formed by a light source and a microlens is configured to contribute to the formation of a light segment that can be activated selectively, in particular by controlling each of the light sources independently. "Activated selectively" should be understood to mean that the light segment can be activated either automatically or by an action by the user, independently or not from the other light segments, which may or may not be adjacent.

The elastic attachment means extend on either side of the optical elements. In other words, these optical elements are arranged in series, and the elastic attachment means are arranged on the end edges of the support in the main direction of said series.

In the predefined position, the optical element is therefore arranged relatively on the support by a stop on the top part of the support and by a stop on the bottom part of the support. These two stops are at an equal distance, or essentially at an equal distance, from the microlenses. This arrangement ensures that the microlenses are in a position in which they cooperate with the light source regardless of manufacturing tolerances that could result in a positioning problem.

The light module can further comprise at least one heat conduction member. The heat conduction member is, in particular, arranged to conduct the heat emitted by the light source to a heat sink.

The heat conduction member comprises a base, configured to be in contact with the support, and at least one gripping finger for positioning the heat conduction member. The base can be integral with the gripping finger, or indeed produced separately.

The gripping finger comprises at least one opening to allow the heat conduction member to be gripped. The opening or openings are arranged to allow the gripping finger to be gripped, in particular by an adjustment machine, so as to correctly orient the heat conduction member such that, when the heat conduction member or members are in the predefined position, the support or supports can be arranged on the corresponding heat conduction member.

The base, the support and the optical element each comprise an attachment opening, the openings facing each other in order to receive an attachment means. The attachment openings of the support and of the optical element are slightly larger than that of the base, in order to compensate for a variance resulting from manufacturing tolerances. The attachment means can be a screw, a rivet, a snap, glue or any other suitable attachment means. More particularly, the attachment means is a screw. The attachment opening of the base comprises a thread matching that of the screw. All the elements of the light module are attached together by a single attachment means.

The base comprises at least one indexing pin and the light source support comprises at least one indexing opening. The indexing pins are intended to cooperate with the indexing openings to position the support correctly on the base before it is attached by the abovementioned attachment means. To this end, the shape and dimensions of the indexing pins match those of the indexing openings.

It should be noted that the optical element is held in position on the support without the final attachment screw, in particular as a result of the combined action of the indexing means, the elastic attachment means and the cooperation of the posts on the shoulder.

The assembly of an optical element, a support and a base has the advantage of creating a light module which can be assembled and adjusted easily in a vehicle headlamp. In particular, attaching the light module according to the invention onto an element of the vehicle headlamp, in particular an attachment plate or a housing, may be envisaged. It is also possible to incorporate more than one light module according to the invention into a vehicle headlamp.

The invention also concerns a lighting device comprising the light module as previously described with a light source support, the light source and the optical element, as well as a projection lens forming a secondary optical element configured to receive and deflect the light rays deflected by the optical element forming the primary optical element.

Each pair formed by a light source and a primary optical element can cooperate with its own individual secondary optical element, or indeed with a shared secondary optical element.

The lighting device described by the invention can advantageously be used for headlamps provided with an ADB (Adaptive Driving Beam) function. Such an ADB function is intended to automatically detect a road user likely to be dazzled by a light beam emitted by a headlamp in the high beam mode, and to modify the contour of said light beam in such a way as to create a shadow area in the location of the detected user. The ADB function has many advantages: comfort of use, better visibility compared to a low beam lighting mode, better reliability in terms of changing mode, a greatly reduced risk of dazzling, and safer driving.

In order to make it possible to modify the light beam, all of the rays emitted by the light sources are divided into vertical segments that can be activated selectively. This division is ensured by separating the light rays by specifically associating one light source with one microlens, the assembly producing few or no stray rays as a result of the presence of a microlens in the direct vicinity of a source. The light module according to the invention is therefore particularly suitable for the application of an ADB function.

BRIEF DESCRIPTION OF THE DRAWINGS

Other features, details and advantages of the invention will become clearer on reading the description that follows as a non-limiting example, with reference to the appended drawings in which.

DETAILED DESCRIPTION

Figure 1:
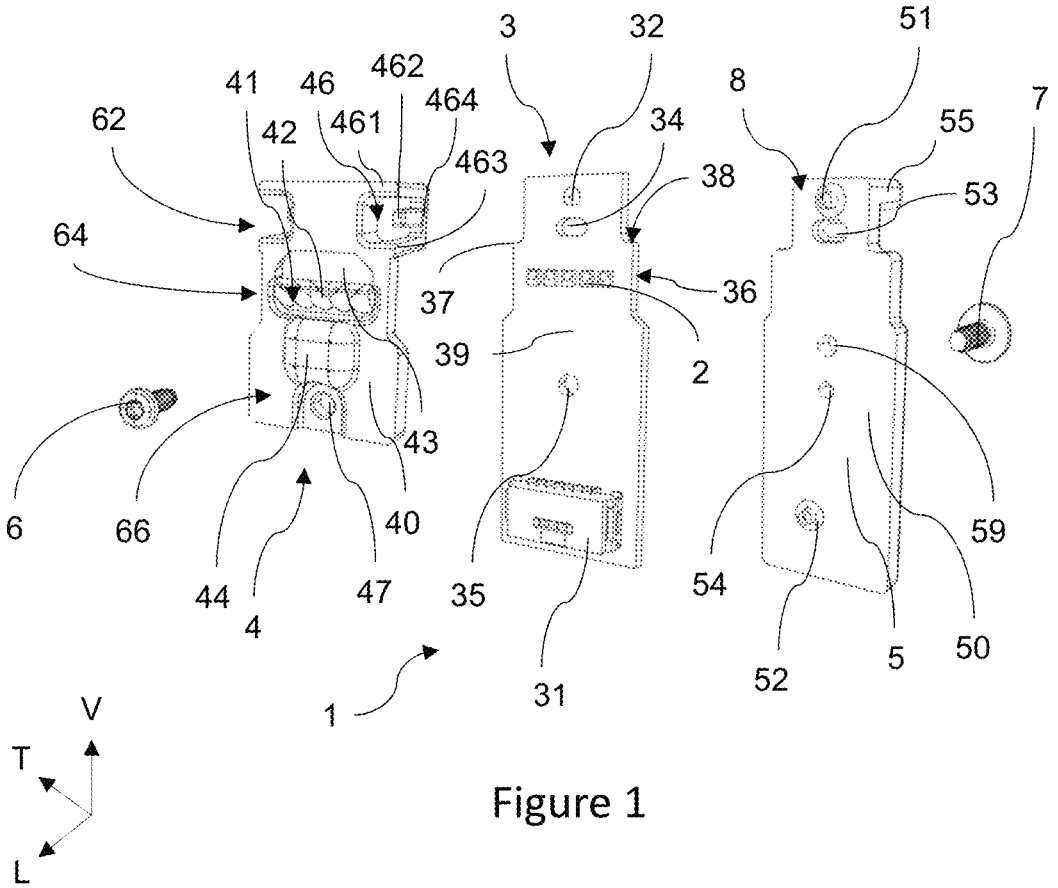
FIG. 1 is an exploded view of a light module according to a first embodiment of the invention, representing, in particular, the front faces of the elements that constitute the module.

In the figures, the parts shown in more than one figure have been given the same reference number.

Hereinafter, the terms longitudinal, vertical and transverse refer to directions relative to an axis corresponding to the general direction of the rays emitted by the light source. The longitudinal direction corresponds to the general direction of the light rays emitted by the light source. The front/forward direction denotes the direction in which the light rays are emitted by the light source, the rear/backward direction designating the opposite direction.

The abovementioned directions can also be seen as an L, V, T trihedron shown in the figures.

The light module 1 comprises at least one light source 2, a light source 2 support 3 and an optical element 4 arranged in the path of the rays emitted by the light source 2, in particular to deflect them and arrange them to help create a motor vehicle lighting and/or signaling beam.

In a first embodiment of the invention, shown in FIGS. 1 to 4, the light module 1 comprises five light sources 2.

The support 3 is generally in the form of a thin panel, delimited by a first face 39 on which the light sources 2 are arranged, and a second face 391 opposite the first. These two faces are delimited by an upper edge, a lower edge, and two side edges. The support 3 can, in particular, comprise a printed circuit board, on which the light sources 2 and electronic components are arranged.

The end of the first face 39 of the support 3 in the vicinity of the upper edge is narrower than the end of the first face 39 in the vicinity of the lower edge. The reduction in width is produced by at least one narrowed area 36 formed by a shoulder 37, which creates a bearing surface 38 substantially parallel to the upper edge of the support 3.

The light sources 2 are arranged on the part of the support 3 arranged between the narrowed area 36 and the lower edge. The light sources 2 are arranged in a transverse series, perpendicular to the side edges of the support 3.

The support 3 comprises, on the first face 39 between the lower edge and the light sources 2, one or more electronic components 31. These electronic components 31 may be of any type and nature allowing a function to be performed in connection with the light module 1, such as the selective activation of one or more light sources 2.

The support 3 further comprises a first indexing opening 32 and a second indexing opening 33, one arranged in the vicinity of the upper edge of the support 3 and the other in the vicinity of the lower edge. In the example shown, these openings 32 and 33 have a cylindrical or essentially cylindrical cross section. The two indexing openings 32 and 33 can be through-openings, i.e. extending from one face of the support 3 to the other.

The support 3 further comprises an oblong indexing hole 34, which is arranged in the vicinity of the first indexing opening 32 and the light sources 2, and a central through-bore 35.

The optical element 4 is arranged facing the first face 39 of the support 3, i.e. the face on which the light sources 2 are arranged. The optical element 4 is in the form of a thin panel, delimited by an inner face 49 that faces the support 3 when the light module is assembled, and an outer face 40 opposite the inner face 49. The width and thickness of the optical element 4 are essentially identical to those of the support 3, and it is shorter in length than the support 3. According to the orientation chosen and shown, in particular, in FIG. 1, the width corresponds to the dimension of the optical element 4 and the support 3 in the transverse direction, the thickness corresponds to the dimension of the optical element 4 and the support 3 in the longitudinal direction, and the length corresponds to the dimension of the optical element 4 and the support 3 in the vertical direction.

The optical element 4 comprises an elastic holding portion 62, a portion 64 for treating the light rays and an attachment portion 66.

The portion 64 for treating the light rays of the optical element 4 comprises one or more microlenses 42, which are arranged in a transverse series in the example shown. The microlens or microlenses 42 protrude from the outer face 40 of the optical element 4, being hemispherical or essentially hemispherical in shape and arranged to cooperate with the light sources 2. As described below, the microlenses 42 are aligned facing the light sources 2 when the optical element 4 is fitted against the support 3, having a longitudinal clearance so as not to crush the light sources 2 when the optical element 4 is pressed against the support 3. The microlenses 42 cooperate with the light sources 2 so as to project the light rays emitted by the light sources 2 in a controlled manner.

These microlenses 42 form primary optical elements 41 when, as described below, the light module 1 formed in part by the optical element 4 is mounted in a lighting device 10 that further comprises a projection lens 104 that thus forms a secondary optical element.

The optical element 4 further comprises a recess 43 and the microlenses 42 are arranged along one of the edges delimiting said recess. In the example shown, the recess is essentially rectangular in shape. It should be noted that the role of this recess 43 is to allow the heat produced by the light sources 2 to be released by air circulation.

Between the portion 64 for treating the light rays and the attachment portion 66, the optical element 4 comprises an arrangement 44 designed to create a clearance between the optical element 4 and the support 3 when said two parts are pressed together. It is therefore possible to arrange a bulky electronic component on the support 3.

The optical element 4 comprises, on the inner face 49, an indexing pin 45 (shown in FIG. 2) that is oblong in shape, arranged on an edge delimiting the recess 43 opposite the microlenses 42. Thus, when the light module 1 is being assembled, the indexing pin 45 of the optical element 4 extends towards the support 3.

The attachment portion 66 of the optical element 4 comprises a through-bore 47. In the example shown, the bore 47 is circular in shape.

The elastic holding portion 62 of the optical element 4 comprises two elastic attachment means 46 arranged respectively on each of the side edges of the optical element 4. These elastic attachment means 46 are arranged on either side of the optical element 4, in the vicinity of the upper edge of the optical element 4. The elastic attachment means 46 extend the panel forming the support element in a substantially perpendicular direction, on the side of the inner face 49, i.e. said elastic attachment means 46 extend in the opposite direction to the microlenses 42.

Each elastic attachment means 46 comprises a frame 461 and an elastic blade 462.

The frame 461 is formed by two longitudinal posts 463 that are integral with the panel of the optical element 4 and extend it in a substantially perpendicular direction, at one of the side edges of the optical element 4. The two longitudinal posts 463 are linked at their free end by a segment 464 which is thus arranged at a distance from the panel of the optical element 4 and carries, at its middle, the elastic blade 462, which extends from the segment 464 in the direction approaching the panel of the optical element 4. This elastic blade 462 is inclined relative to the parallel longitudinal posts 463 insofar as it extends towards the inside of the optical element 4. In other words, it has a transverse component so as to extend in a direction approaching the elastic blade 462 of the other elastic attachment means 46.

As described in greater detail below, the elastic attachment portion 66 is configured in such a way that, when the optical element 4 is in the predefined position, each of the frames 461, and in particular the lower longitudinal post 463, rests on the bearing surface 38 formed by the corresponding shoulder 37 of the support 3, and the free end of each elastic blade 462, opposite the segment 464, is in contact with the second face 391 of the support. The cooperation of the posts 463 and elastic blades 462 of the optical element 4 with the appropriate shapes provided on the support 3 help hold the optical element 4 in position.

The light module 1 further comprises a heat conduction member 8 against which the support 3 presses. The heat conduction member 8 comprises a base 5, the shapes and dimensions of which are essentially similar to those of the support 3.

The base 5 has a contact face 50 on which at least a first indexing lug 51 and a second indexing lug 52 are provided, the shape of which matches the first and second openings 32 and 33 provided in the support. When the support 3 is fitted against the base 5, these indexing lugs 51 and 52 are arranged opposite the indexing openings 32 and 33 of the support 3, so as to allow the support 3 to be positioned relative to the base 5.

The base 5 also comprises, on the face opposite the contact face 50 against which the support 3 presses, at least one first gripping finger 55 that extends the base 5 in a substantially perpendicular direction and is arranged at an end of the base 5 in the vicinity, in this case, of the upper edge. In the example shown, a second gripping finger 56 is provided such that said gripping fingers 55 and 56 are each arranged at one end of the base 5. The gripping fingers 55 and 56 can extend over all or part of the width of the base 5.

The gripping fingers 55 and 56 are both intended to allow the base 5 to be gripped in order to allow said base 5, and therefore the entire light module 1, to be oriented correctly before it is attached to a lighting and/or signaling device in the vehicle. For this purpose, the first gripping finger 55 comprises two gripping openings 57 and 58 configured to cooperate with any machine tool that can be used for producing, assembling or adjusting the light module 1. The gripping openings 57 and 58 are arranged on the upper face of the first gripping finger 55. In the embodiment of the example, one of the gripping openings 57 and 58 is a through-opening, and the other is not.

The base 5 further comprises an attachment hole 59 that extends through the thickness of the base from the face opposite the contact face 50 against which the support 3 is pressed. In the example shown, this attachment hole 59 is a through-hole, i.e. it opens on the contact face 50, but it should be noted that it can be a blind hole. As detailed below, the purpose of this attachment hole 59 is to help attach the base 5 and therefore the whole of the light module 1 on a housing of a lighting and/or signaling device. It can, in particular, be tapped in order to receive an attachment screw 7.

Moreover, the base 5 comprises an oblong indexing ring 53, the shape of which is substantially equal to the oblong shape of the indexing hole 34 provided in the support 3.

The base 5 also comprises, substantially at its center, a threaded bore 54, which extends through the thickness of the base 5 from the contact face 50 arranged to be in contact with the support 3. In the example shown, it can be seen, in particular, that the threaded bore 54 is not a through-bore and is actually a blind bore.

The indexing pin 45 of the optical element 4 is arranged to cooperate with the indexing hole 34 and the indexing ring 53 in order to help position the optical element 4 on the support 3.

Figure 3:
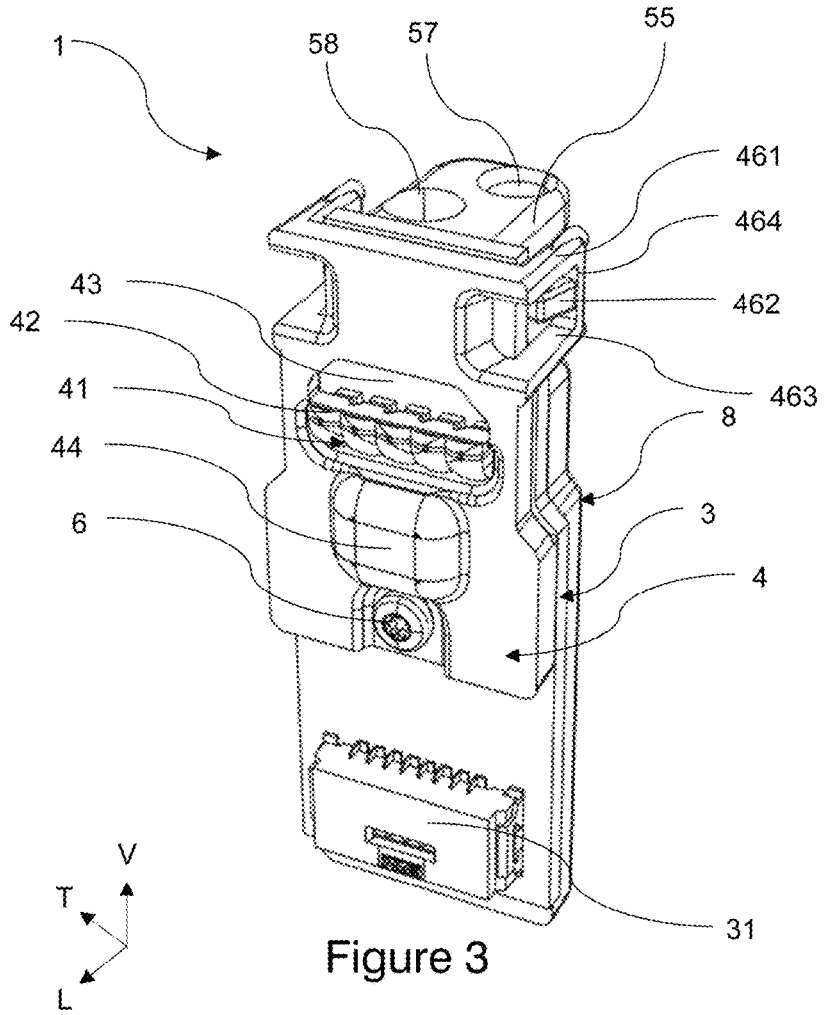
FIG. 3 is a perspective view of an assembled light module, according to a first embodiment of the invention.
Figure 4:
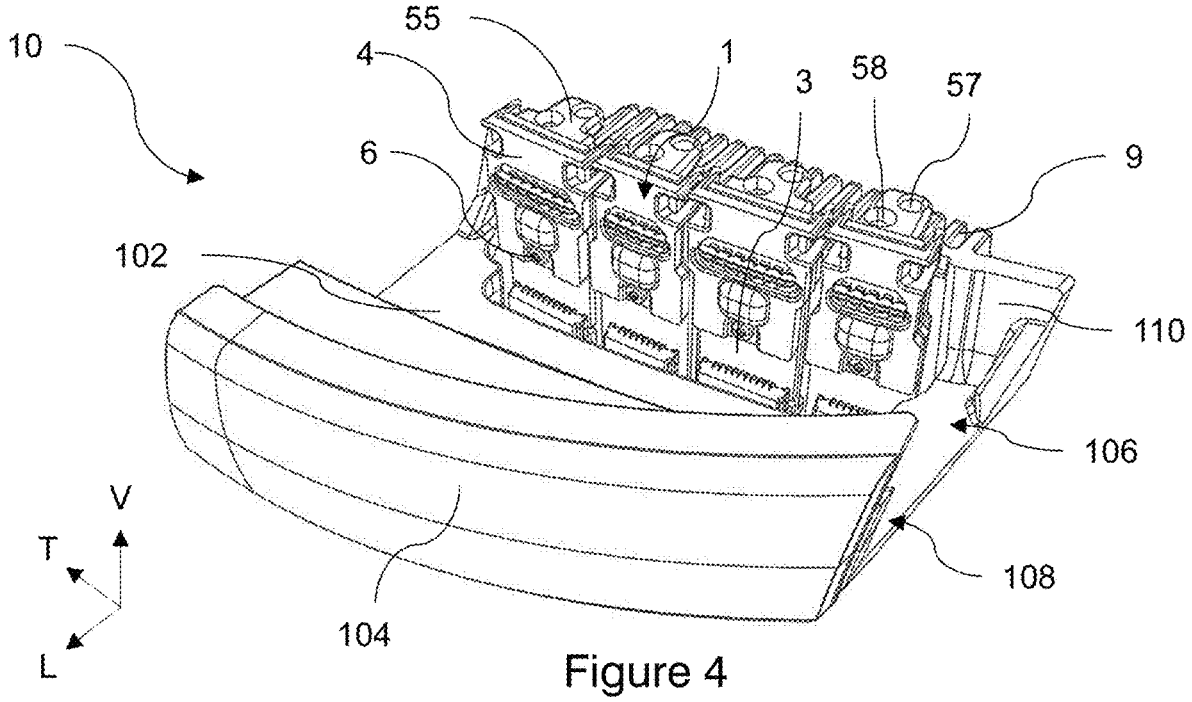
FIG. 4 is a perspective view of a lighting device comprising several light modules according to the invention.

In reference to FIG. 4, there now follows a description of the light module 1 formed by the cooperation of each of the elements described above. FIG. 3 shows a light module 1 assembled according to the invention.

First, the support 3 is arranged on the heat conduction member 8, and more particularly on its base 5. For this purpose, the second face 391 of the support 3 is positioned facing the contact face 50. The edges of the base 5 and of the support 3 are substantially aligned, thus matching up the indexing means. The indexing lugs 51 and 52 carried by the base 5 penetrate into the indexing openings 32 and 33 provided in the support, thus positioning the support 3 relative to the base 5. In this relative position, the indexing ring 53 is positioned facing the indexing hole 34 of the support 3, and the central bore 35 of the support 3 is aligned with the central threaded bore 54 arranged on the base 5. It should be noted that the diameter of the central bore 35 is greater than that of the central threaded bore 54.

The optical element 4 is then arranged on the support 3, bringing the inner face 49 of the optical element 4 to face the first face 39 of the support 39. The elastic attachment means 46 are then turned towards the support 3. First, the optical element 4 is pre-positioned by resting the lower longitudinal post 463 of the frame 461 of each elastic attachment means 46 on the bearing surface 38 formed by the shoulder edge 37 provided on the support 3. Next, the optical element 4 is slid longitudinally, i.e. perpendicular to the plane defined by the support 3, along said bearing surface 38, it being understood that the shape of the base 5 is defined in such a way as not to impede this sliding movement.

As the optical element 4 is being moved towards the support 3, the elastic blades 462, the original shape of which is inclined towards the center of the optical element 4, come into contact with the side edge of the support 3. The elastic blades 462 are configured to be elastically deformed towards the outside of the optical element 4 and allow the sliding movement to take place.

Moreover, the sliding of the optical element 4 brings the indexing pin 45 arranged on the inner face 49 of the optical element 4 to face the indexing hole 34 provided in the support 3. This can result in an adjustment of the position of the optical element 4 relative to the support 3, in order to allow the indexing pin 45 to be inserted into the indexing hole 34, and then into the indexing ring 53 provided in the base 5 and arranged in the immediate continuation of the indexing hole 34. Therefore, the frame 461 of the elastic attachment means 46 and the indexing pin 45, and the bearing surface 38 formed by the shoulder edge 37 and the indexing hole 34, form means for positioning the optical element 4 on the support in a predefined position.

Figure 2:
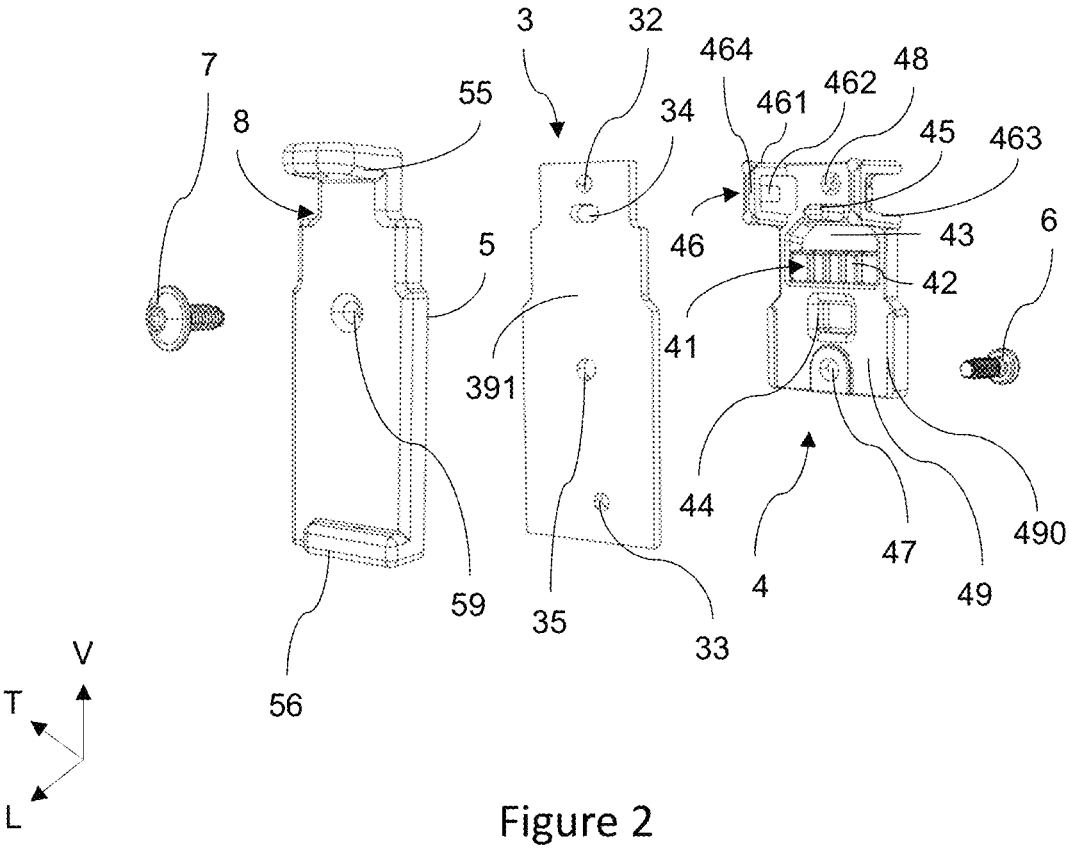
FIG. 2 is an exploded view of the light module of FIG. 1, in particular showing the rear faces of the elements shown in FIG. 1.

When the sliding movement is complete, the optical element 4 is in contact with the support 3, or in the direct vicinity of same, it being understood that said parts are configured in such a way that the light sources 2 are not crushed by the optical element 4 in this desired position. In particular, the microlenses 42 are provided on the edge of the recess 43 and are slightly offset in a longitudinal direction relative to the inner face 49 of the optical element 4. As shown in FIG. 2, the optical element 4 can also be provided with beads 490 allowing the optical element 4 to be pressed against the support 3 without crushing the light sources 2.

The cooperation of the positioning means, i.e. the positioning means 45 carried by the optical element 4 and the complementary positioning means carried by the support 3, in particular, makes it possible to obtain a predefined position, in which the through-bore 47 arranged in the attachment portion 66 of the optical element 4 is positioned in front of the central bore 35 of the support and the central threaded bore 54 of the base 5. These three bores 54, 35 and 47 are therefore aligned and configured to receive a first attachment means 6, it being understood that the through-bore 47 of the optical element 4 has a larger diameter than that of the central threaded bore 54 of the base 5.

In the predefined position, the elastic blades 462 extend beyond the panel forming the support 3 and are no longer in contact with a side edge of said panel. They therefore return to their original shape, tending to move closer together towards the center of the optical element 4. The free end of each elastic blade 462 thus moves into position behind the panel forming the support 3, opposite the second face 391. The support 3 then forms a stop preventing the release of the elastic blades 462 and therefore the release of the optical element 4. If the optical element 4 needs to be replaced, the elastic blades 462 can be pushed apart with a certain force in order to release them from the support 3. During operation, without external intervention by an operator, the positioning of the optical element 4 relative to the support 3 and, therefore, the positioning of the microlenses 42 relative to the light sources 2, is reliable.

Finally, the first attachment means 6 are used to hold the optical element 4, the support 3 and the base 5 together. In the example shown, the first attachment means 6 is an attachment screw, the head of the attachment screw being on the optical element 4 side.

The optical element 4 is then attached relative to the support 3 at three points, and it can be seen that the center of these three points is positioned substantially in the vicinity of the microlenses 42, ensuring the reliable positioning of the microlenses 42 relative to the light sources 2, regardless of manufacturing tolerances.

The method of assembling the light module 1 according to the invention described below is no more than an example of assembly. It is in no way limiting and it would, in particular, be quite possible to first assemble the optical element 4 on the support 3, and then assemble this sub-assembly on the heat conduction member 8 and its base 5.

The light module 1 formed in this way can then be mounted on a housing or a plate of a lighting device via a second attachment means 7, in particular an attachment screw that cooperates with the attachment hole 59 provided in the base 5.

FIG. 4 illustrates a lighting device 10 comprising several light modules 1 according to the invention and, in particular, as has just been described, consisting of a heat conduction member 8, a support 3 and an optical element 4 forming a sub-assembly that can be produced individually and then attached to the housing or plate of the lighting device.

Each light module 1 according to the invention is attached to a plate 102 by a second attachment means 7. In the example shown, the light modules 1 are arranged on an axial end of the plate 102 and are carried by a vertical wall 110 of the plate 102, which also carries, on the opposite face, a heat sink 9, in this case a finned heat sink.

The device moreover comprises a lens 104, arranged at an axial end of the plate 102 opposite that where the light modules 1 are arranged. In this way, an optical system is formed comprising a primary optical element 41 formed by the microlenses 42 in the direct vicinity of the light sources 2 and a secondary optical element 104, each of these optical elements being configured to contribute to the formation of a motor vehicle lighting and/or signaling beam from the light rays initially emitted by the light sources 2.

Figure 5:
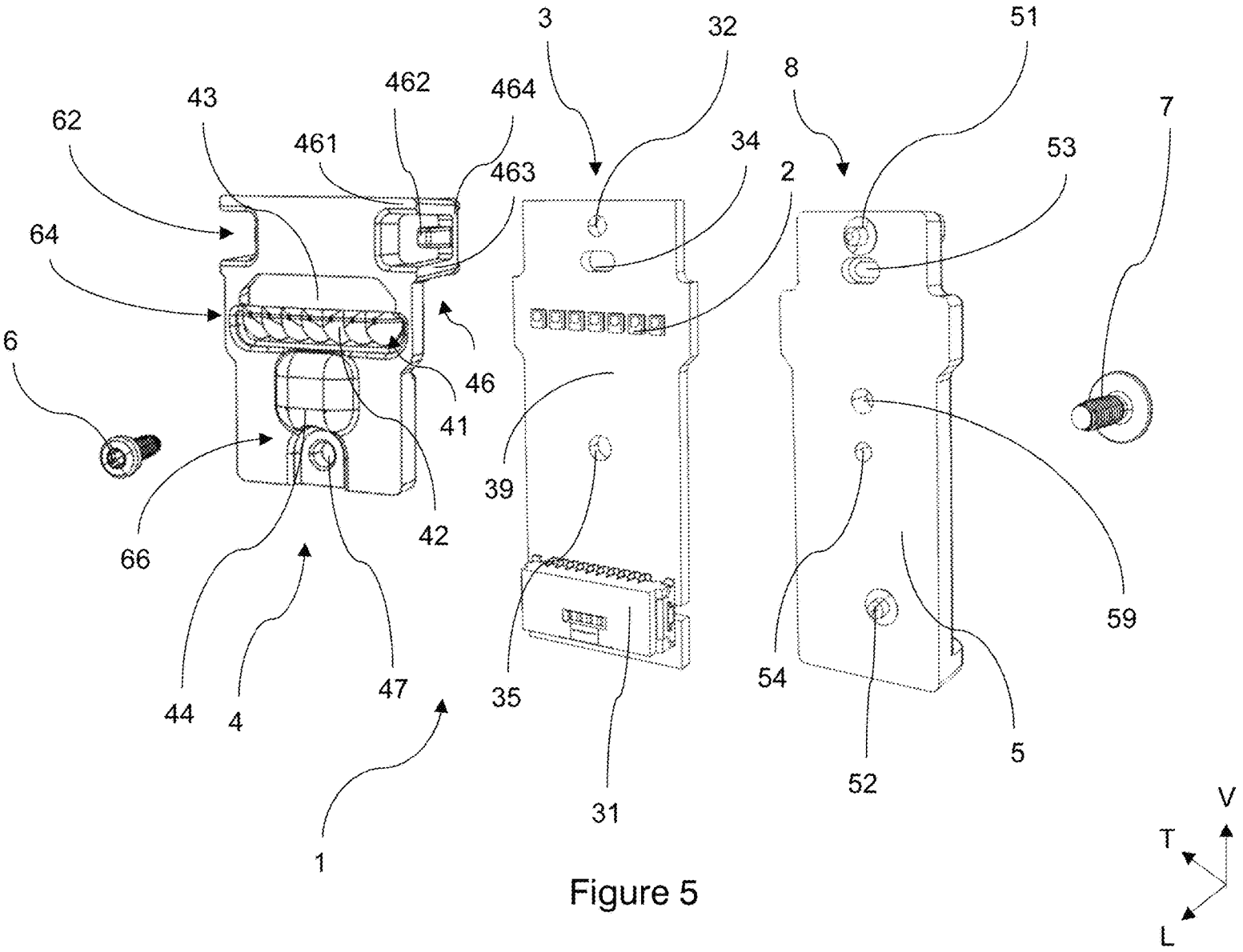
FIG. 5 is an exploded view of a light module according to a second embodiment of the invention, from a perspective similar to that of FIG. 1.

In particular, it can be seen in FIG. 4 that some of the light modules 1 comprise a different number of light sources 2 and associated microlenses 42. FIG. 5 therefore shows a second embodiment of the light module that differs from the first previously described embodiment in that the support 3 comprises seven light sources 2, the optical element 4 correspondingly comprising seven microlenses 42 forming the primary optical element 41.

As a result, the support 3 is wider at the portion 64 for treating the light rays in order to accommodate the series of light sources 2. The other features and elements of the light module 1 in this second embodiment are identical or essentially identical to those disclosed in the description of the first embodiment.

The embodiments described above are in no way limiting; in particular, it is possible to envisage variants of the invention that only comprise a selection of the features described below in isolation from the other described features, if said selection of features is sufficient to give the invention a technical advantage over or distinguish it from the prior art.

The invention claimed is:

1. A light module comprising:

a printed circuit board comprising a series of light sources mounted along a transverse direction on a front face of the printed circuit board such that each light source has a light emitting path which extends along a longitudinal direction away from the front face of the printed circuit board;

an optical element coupled to the printed circuit board, the optical element comprising a series of microlenses arranged along the transverse direction;

an alignment mechanism configured to align the optical element with the printed circuit board such that each microlens in the series of microlenses is provided in the light emitting path of a respective one of the light sources in the series of light sources; and a heat conduction member shaped and dimensioned to correspond to the printed circuit board, the heat conducting member being fixed to the printed circuit board such that a front face of the heat conduction member is coupled to a rear face of the printed circuit board to conduct heat generated by the series light sources away from the series of microlenses.

2. The light module of claim 1, wherein the heat conduction member is a metal heat conduction member.

3. The light module of claim 1, wherein the heat conduction member further comprises a light module mounting hole for mounting the heat sink of the housing to the light module.

4. The light module of claim 2, wherein:

the printed circuit board further comprises electrical components mounted only on the front face of the printed circuit board, and the rear face of the printed circuit board is a smooth surface of insulating material which contacts the front face of the metal heat conduction member to conduct heat generated by the series light sources away from the series of microlenses.

5. The light module according to claim 4, further comprising at least one screw to attach the metal heat conduction member to the printed circuit board.

6. The light module of claim 1, wherein the alignment mechanism comprises:

at least one indexing pin coupled to the optical element, and at least one indexing opening in the printed circuit board, wherein each indexing opening being shaped and dimensioned to correspond to a respective indexing pin such that the at least one indexing pin engages a respective one of the at least one indexing opening to align the series of microlenses with the series of lighting devices when the lighting module is assembled.

7. The light module of claim 6, wherein the a heat conduction member further comprises at least one additional indexing opening being shaped and dimensioned to correspond to a respective indexing pin such that the at least one indexing pin further engages a respective one of the at least one additional indexing opening of the heat conduction member when the lighting module is assembled.

8. The light module of claim 1, wherein the at least one indexing pin is an integral part of the optical element.

9. The light module of claim 1, wherein the at least one indexing pin and the optical element are made of different materials as separate parts of an optical element assembly.

10. The light module of claim 1, wherein the heat conduction member further comprises a light module mounting hole.

11. A light module assembly comprising:

a plurality of the light modules of claim 10;

a heat sink having a plurality of mounting surfaces each being configured to receive a respective one of the plurality of light modules, each mounting surface having at least one heat sink mounting hole corresponding to a respective one of the light module mounting holes; and a plurality of screws each engaging a respective light module mounting hole and a corresponding heat sink mounting hole when the plurality of light modules are mounted on respective mounting surface of the heat sink.

12. The light module assembly of claim 11, wherein a rear face of each heat conduction member contacts a respective mounting surface of the heat sink such that the heat conduction member conducts heat toward the heat sink and away from the microlenses.

13. A light device for a vehicle comprising:

a housing for the light device, the housing comprising:

a heat sink having a vertical wall including a front face including a mounting surface and a rear face including heat fins, and a lens having a rear input surface facing the mounting surface of the heat sink, the lens being coupled to the heat sink such that the rear input surface of the lens is spaced apart from the mounting surface of the heat sink along a longitudinal direction of the light device; and a light module mounted to the mounting surface of the heat sink, the light module comprising:

a printed circuit board comprising a series of light sources mounted along a transverse direction on a front face of the printed circuit board such that each light source has a light emitting path which extends along the longitudinal direction away from the front face of the printed circuit board;

an optical element coupled to the printed circuit board, the optical element comprising a series of microlenses arranged along the transverse direction;

an alignment mechanism configured to align the optical element with the printed circuit board such that each microlens in the series of microlenses is provided in the light emitting path of a respective one of the light sources in the series of light sources; and a heat conduction member shaped and dimensioned to correspond to the printed circuit board, the heat conducting member being fixed to the printed circuit board such that a front face of the heat conduction member is coupled to a rear face of the printed circuit board, at least one screw configured to attach the light module to the mounting surface of the heat sink such that the light path of each of the light sources is incident on the rear face of the lens.

14. The light device of claim 13, wherein a rear face of the heat conduction member is coupled to the mounting surface of the heat sink such that the heat conduction member conducts heat toward the heat sink and away from the microlenses.

15. The light device of claim 14, wherein:

the heat conduction element is a metal heat conduction element, the printed circuit board further comprises electrical components mounted only on the front face of the printed circuit board, and the rear face of the printed circuit board is a smooth surface of insulating material which contacts the front face of the metal heat conduction member to conduct heat generated by the series light sources away from the series of microlenses.

16. The light device of claim 15, further comprising at least one screw to attach the metal heat conduction member to the printed circuit board.

17. The light device of claim 13, wherein the alignment mechanism comprises:

at least one indexing pin coupled to the optical element, and at least one indexing opening in the printed circuit board, wherein each indexing opening being shaped and dimensioned to correspond to a respective indexing pin such that the at least one indexing pin engages a respective one of the at least one indexing opening to align the series of microlenses with the series of lighting devices when the lighting module is assembled.

18. The light device of claim 17, wherein the a heat conduction member further comprises at least one additional indexing opening being shaped and dimensioned to correspond to a respective indexing pin such that the at least one indexing pin further engages a respective one of the at least one additional indexing opening of the heat conduction member when the lighting module is assembled.

19. The light module of claim 13, wherein the at least one indexing pin is an integral part of the optical element.

20. The light module of claim 13, wherein the at least one indexing pin and the optical element are made of different materials as separate parts of an optical element assembly.

* * * * *